US006719646B2

(12) United States Patent
Calabria et al.

(10) Patent No.: US 6,719,646 B2
(45) **Date of Patent: *Apr. 13, 2004**

(54) POLYURETHANE COVERED THREE-PIECE GOLF BALL

(75) Inventors: John A. Calabria, Easley, SC (US); Sanjay M. Kuttappa, Clemson, SC (US); Matthew B. Stanczak, Westminster, SC (US); Jens A. John, Westminster, SC (US); George R. Wallace, Clemson, SC (US); Lane D. Lemons, Jackson, TN (US)

(73) Assignee: Dunlop Slazenger Sports, Westminster, SC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/490,918

(22) Filed: Jan. 25, 2000

(65) Prior Publication Data

US 2002/0098914 A1 Jul. 25, 2002

(51) Int. Cl.[7] ..... A63B 37/12
(52) U.S. Cl. ..... 473/378; 473/383; 473/357
(58) Field of Search ..... 473/354, 356, 473/357, 362, 363, 365, 368, 370, 378, 383, 384, 385

(56) References Cited

U.S. PATENT DOCUMENTS

| | | | | |
|---|---|---|---|---|
| 2,117,400 A | | 5/1938 | Cobb | |
| 2,225,213 A | * | 12/1940 | Gammeter | 473/354 |
| 3,034,791 A | | 5/1962 | Gallagher | |
| 3,112,521 A | | 12/1963 | Ward | |
| 3,130,102 A | | 4/1964 | Watson | |
| 3,147,324 A | | 9/1964 | Ward | |
| 3,177,280 A | | 4/1965 | Ford | |
| 3,989,568 A | | 11/1976 | Isaac | |
| 4,123,061 A | | 10/1978 | Dusbibner | |
| 4,595,742 A | | 6/1986 | Nalepa | |
| 4,631,298 A | | 12/1986 | Presswood | |
| 4,786,656 A | | 11/1988 | Presswood | |
| 4,932,664 A | * | 6/1990 | Pocklington et al. | 473/378 |
| 5,002,806 A | | 3/1991 | Chung | |
| 5,059,634 A | | 10/1991 | Smith | |
| 5,334,673 A | | 8/1994 | Wu | |
| 5,421,580 A | | 6/1995 | Sugimoto | |
| 5,597,365 A | * | 1/1997 | Yamada et al. | 473/354 |
| 5,614,575 A | | 3/1997 | Kotschwar | |
| 5,628,699 A | | 5/1997 | Maruko et al. | |
| 5,654,085 A | | 8/1997 | Markusch et al. | |
| 5,692,974 A | | 12/1997 | Wu et al. | |
| 5,704,852 A | | 1/1998 | Kato | |
| 5,733,428 A | | 3/1998 | Calabria | |

(List continued on next page.)

FOREIGN PATENT DOCUMENTS

| | | |
|---|---|---|
| DE | 19732313 A1 | 2/1998 |
| EP | 0219709 A2 | 4/1987 |

(List continued on next page.)

OTHER PUBLICATIONS

Louis G. Caschera, Jr. Strictly Golf Balls 1998, StrictlyGolf, Inc. pp. 28–29.*

*Primary Examiner*—Mark S. Graham
*Assistant Examiner*—Raeann Gordon
(74) *Attorney, Agent, or Firm*—Lorusso Loud & Kelly LLP

(57) ABSTRACT

A urethane-covered three-piece golf ball with a liquid-filled center, having a combination of center weight, thread windings, dimple configuration and compression that allows it to travel great distances, and to match the classic feel of 'Balata' balls, said combination at the same time complying with USGA regulations.

39 Claims, 7 Drawing Sheets

U.S. PATENT DOCUMENTS

| | | | | | |
|---|---|---|---|---|---|
| 5,823,888 | A | * | 10/1998 | Maruko et al. | 473/354 |
| 5,846,142 | A | * | 12/1998 | Kakiuchi et al. | 473/354 |
| 5,885,172 | A | * | 3/1999 | Hebert et al. | 473/354 |
| 5,888,437 | A | | 3/1999 | Calabria | |
| 5,897,884 | A | | 4/1999 | Calabria | |
| 6,200,230 | B1 | * | 3/2001 | Maruko | 473/354 |

FOREIGN PATENT DOCUMENTS

| | | | | | |
|---|---|---|---|---|---|
| EP | 0219709 | A | | 4/1987 | |
| EP | 0312374 | A | | 4/1989 | |
| EP | 0312 374 | A2 | | 4/1989 | |
| EP | 0557069 | A1 | | 8/1993 | |
| EP | 0570798 | A | | 11/1993 | |
| EP | 0578 466 | A | | 1/1994 | |
| EP | 0674923 | A1 | | 4/1995 | |
| EP | 0652254 | A1 | | 5/1995 | |
| EP | 0664206 | A | | 7/1995 | |
| EP | 674923 | | | 10/1995 | |
| GB | 2239458 | A | | 7/1991 | |
| GB | 2301291 | A | | 4/1996 | |
| GB | 2296497 | A | | 7/1996 | |
| GB | 2301779 | A | | 12/1996 | |
| GB | 2307865 | A | | 6/1997 | |
| WO | 95302167.2 | | | 4/1995 | |
| WO | 9608820.8 | | | 4/1996 | |
| WO | 9611724.7 | | | 6/1996 | |
| WO | 9625430.5 | | | 12/1996 | |
| WO | WO9837929 | A | | 9/1998 | |
| WO | WO 98/37929 | | * | 9/1998 | A63B/37/06 |

* cited by examiner

POLYURETHANE COVERED THREE-PIECE GOLF BALL

BACKGROUND OF THE INVENTION

1. Field of the Invention

The instant invention is directed to golf balls, and more particularly to a ball having the optimal cover composition, cover hardness, center weight, the size of the thread windings, and dimple configuration to provide superior playability capabilities with respect to softness and spin without sacrificing superior distance capabilities.

2. Description of the Related Art

There are a number of physical properties that affect the performance of a golf ball. The core of the golf ball is the source of the ball's major elastic properties. Among other things, the core affects the ball's "feel" and its initial velocity. The initial velocity is the velocity at which the golf ball travels immediately following impact. The initial velocity can be grouped with launch angle and spin to describe the ball's initial conditions, or the conditions exhibited by the ball immediately after impact. The initial conditions along with dimple pattern determine the ball's trajectory and ultimately its distance. The "feel" is the overall sensation transmitted to the golfer through the golf ball at impact. The overall construction of the ball influences the "feel" of a golf ball. Properties such as cover hardness, compression, and rebound can be used to gauge the response of a golfer to a ball's construction. But ultimately, the ball's "feel" can only be determined by the avid golfer. One property commonly tested by golfers to judge the "feel" of a ball is the sound made at impact between the ball and the club. This sound or "click" provides the golfer with a lasting impression of the ball's feel. Generally, lower cover hardness, compression, and rebound give the golfer an impression of a softer "feel" and a corresponding lower, softer click.

Until the late 1960's, most golf balls were constructed with a thread wound core and a cover of compounds based on natural balata and gutta percha or synthetic transpolyisoprene. These golf balls have been and are still known to provide good flight distance. Additionally, due to the relative softness of the balata cover, skilled golfers can impart various spins on the ball in order to control the ball's flight path (e.g., "fade" or "draw") and "bite" characteristics upon landing on a green.

"Fade" is a term used in golf to describe a particular golf ball flight path that is characterized by a curved or arched flight exhibited towards the latter portion of the flight path that veers off from the center line of the initial flight path to the opposite side from which the golfer stands. Upon contact with the ground, a ball hit with a "fade" will stop in a relatively short distance. This is a result of an open club face at impact imparting more spin and a higher trajectory than normal.

"Draw" is the term used in golf to describe a particular golf ball flight path that is characterized by a curved or arched flight exhibited towards the latter portion of the flight path that veers off from the center line of the initial flight path to the same side on which the golfer stands. Upon contact with the ground, a ball hit with a "draw", unlike that of a ball hit with a "fade", will roll for a considerable distance. This is a result of a closed club face at impact imparting less spin and a lower trajectory than normal.

"Check" or "bite" is the term used in golf to describe the effect of imparting a substantial amount of backspin to an approach shot to a green that causes the golf ball to stop abruptly upon contact with the green.

Another desirable feature of balata-based compounds is that they are readily adaptable to molding. These compounds therefore can be easily compression molded about a spherical core to produce golf balls.

Though possessing many desirable properties, there are substantial drawbacks to use of balata or transpolyisoprene-based compounds for golf ball covers. From a manufacturing standpoint, balata-type materials are expensive and the manufacturing procedures used are time consuming and labor-intensive, thereby adding to the material expense. From a player's perspective, golf balls constructed with balata-based covers are very susceptible to being cut from mishits and being sheared from sharp grooves on a club face. As a result, they have a relatively short life span.

In response to these drawbacks to balata-based golf ball covers, the golf ball manufacturing industry has shifted to the use of synthetic thermoplastic materials, most notably ionomers sold by E. I. DuPont De Nemours & Company under the name SURLYN®. Surlyn is an ionomeric resin that is an ionic copolymer of an olefin having from about 2 to about 8 carbon atoms, such as ethylene, and a metal salt of an alpha, beta-ethylenically unsaturated mono- or dicarboxylic acid such as acrylic acid, methacrylic acid, or maleic acid. The pendent ionic groups in the ionomeric resins interact to form ion-rich aggregates contained in a non-polar polymer matrix. Metal ions, such as sodium, zinc, or lithium are used to neutralize some portions of the acid groups in the copolymer resulting in a thermoplastic elastomer exhibiting enhanced properties such as improved durability.

Thread wound balls with ionomer covers are less costly to manufacture than balls with balata covers. They are more durable and produce satisfactory flight distance. However, these materials are relatively hard compared to balata and thus lack the "feel" of a balata covered golf ball.

In an attempt to overcome the negative factors of the hard ionomer covers, DuPont introduced low modulus SURLYN® ionomers in the early 1980's. These SURLYN® ionomers have a flexural modulus of from about 3000 to about 7000 PSI and hardness of from 25 to about 40 as measured on the Shore D scale—ASTM 2240. The low modulus ionomers are terpolymers, typically of ethylene, methacrylic acid and n or iso-butylacrylate, neutralized with sodium, zinc, magnesium or lithium cations. E.I. DuPont De Nemours & Company has disclosed that the low modulus ionomers can be blended with other grades of previously commercialized ionomers of high flexural modulus from about 30,000 to 55,000 PSI to produce balata-like properties. However, "soft" blends, typically 52 Shore D and lower (balata-like hardness), do not exhibit good physical properties and are prone to cut and shear damage.

The low modulus ionomers when used without blends produce covers with very similar physical properties to those of balata, including poor cut and shear resistance. Worse, wound balls with these covers tend to go "out-of-round" quicker than wound balls with balata covers. Blending with hard SURLYN® ionomers was found to improve these properties.

Another approach taken to provide a golf ball cover that has the playing characteristics of balata is described in U.S. Pat. No. 5,334,673 (the '673 patent) assigned to the Acushnet Company. The '673 patent discloses a cover composition comprising a diisocyanate, a polyol and a slow-reacting polyamine curing agent. The diisocyanates claimed in the '673 patent are relatively fast reacting. Due to this fact, catalysts are not needed to lower the activation energy threshold. However, since relatively fast-reacting prepolymer systems are used, the reaction rate cannot be easily controlled thereby requiring the implementation of substantial processing controls and precise reactant concentrations in order to obtain a desired product.

To avoid the problems associated with fast-reacting prepolymer systems, slow-reacting systems such as Toluene diisocyanate (TDI) prepolymer systems can be employed. However, these systems, while avoiding the problems associated with fast-reacting systems, present similar problems, albeit for different reasons. The most noteworthy problem with slow-reacting pre-polymer systems is the requirement for a catalyst.

By introducing a catalyst into the system, processing problems similar to those associated with fast-reacting prepolymer systems are virtually inevitable. As is well known in the art, the use of a catalyst can severely restrict the ability to control the speed of the reaction, which is undesirable.

Historically, in addition to manipulating the cover composition of a golf ball, golf ball manufacturers have also varied the size and winding conditions of the thread windings layer as well as the weight of the center in three-piece golf balls in an effort to design a golf ball with superior ball performance. Various efforts have been made to select the optimal winding pattern as well as the ideal thread dimension and winding tension.

For many years golf ball manufacturers have also investigated changing dimple configurations in an effort to design a ball with superior distance capabilities. Dimples are the surface indentations or depressions on a golf ball. Specifically, many efforts have been made to select the optimum number, size and shape of dimples as well as their disposition around the outer surface of a generally spherically shaped golf ball.

As is well known in the art, ball manufacturers are bound by regulations of the United States Golf Association (USGA) which control many characteristics of the ball, including the size and weight of the ball, the initial velocity of the ball when tested under specified conditions, the overall distance the ball travels when hit under specified test conditions, and the ball's aerodynamic symmetry. Under USGA regulations, the diameter of the ball cannot be less than 1.680 inches, the weight of the ball cannot be greater than 1.620 ounces avoirdupois, the initial velocity of the ball cannot be greater than 250 feet per second when tested under specified conditions (with a maximum tolerance of +2%), the driver distance cannot exceed 280 yards when tested under specified conditions (with a test tolerance of +6%), and the ball must perform the same aerodynamically, regardless of the orientation.

OBJECT OF THE INVENTION

Accordingly, it is an object of the instant invention to optimize the combination of center weight, core compression, size and winding conditions of the thread layer, dimple configuration, cover composition, and cover hardness to provide a three-piece golf ball, which travels great distances, and at the same time complies with USGA regulations.

It is another object of the instant invention to provide a three-piece golf ball that has a soft "feel" in combination with superior distance capabilities.

It is yet another object of the instant invention to provide a three-piece golf ball having a synthetic cover material that achieves the sound, feel, and playability and flight performance qualities of balata covered golf balls.

It is still a further object of the instant invention is to provide a three-piece golf ball having superior distance, trajectory and flight stability.

Another object of the instant invention is to provide a three-piece golf ball having a surface divided into a plurality of polygonal configurations or shapes for the location of dimples for enhancing the aerodynamic properties of the golf ball.

It is yet another object of the present invention to provide a golf ball cover composition that does not require a catalyst.

It is still a further object of the invention to provide a polyurethane formula that achieves hardness characteristics similar to those associated with balata without compromising the durability of the polyurethane material. In contrast, polyurethane systems such as those disclosed in the '673 patent produce relatively high hardness ranges that obviate the possibility of providing a polyurethane system that can truly mimic the feel and playability of a balata-based product.

A further object of the present invention is to provide a golf ball cover material that has improved process manufacturing as well as improved durability and resilience over balata.

These and other objects of the instant invention will be apparent from a reading of the detailed description of the instant invention.

SUMMARY OF THE INVENTION

The invention achieves the above-described objectives by providing a three-piece golf ball having a heavy liquid-filled rubber center, a thread windings layer whose threads are a large gauge and which is wound to an "open" great circle pattern, a "soft" polyurethane cover, and a "rhombicosadodecahedron" dimple pattern. The ball of the instant invention has a core compression in the range of 70 PGA to 100 PGA, a center weight in the range of 17–19 grams, an unstressed (not wound) thread dimension of about 0.024±0.004 inches height by $1/16^{th}$ of an inch width, a cover hardness in the range of about 46 Shore D to about 54 Shore D, and a dimple pattern based on the geometry of a rhombicosadodecahedron. This combination has been found to produce a ball with superior distance capabilities and superior playability capabilities with respect to softness and spin. The use of these properties in the golf ball of the instant invention is based on the recognition that it is the combination of the center weight, the size and pattern and tension of the thread windings, cover hardness, dimple configuration, dimple size and dimple shape that will produce a ball that will travel the greatest distance without compromising shot-making feel.

Table 1, below, provides an example of some test data on the performance of the ball of the invention versus a standard wound, balata, three-piece ball.

TABLE 1

Table 1. Instant invention versus a standard wound, balata, three-piece ball.

| Ball Identification | Carry (yards) | Roll (yards) | Total (yards) | Launch Angle (degrees) | Spin (rpm) | Initial Velocity (ft/s) |
|---|---|---|---|---|---|---|
| Instant Invention | 245.9 | 26.3 | 272.2 | 8.6 | 2871 | 228 |
| Classic 3-pc Wound | 242.9 | 27.0 | 269.9 | 8.6 | 2931 | 229 |

The Liquid-Filled Center

The golf ball of the present invention has a conventional, heavy, liquid-filled, spherical rubber center or rubber sphere that will be described in more detail in a later section. In a preferred embodiment of the invention, the center has a weight that is slightly heavier than in golf balls manufactured previously.

The Thread Windings Layer

The thread of the golf ball of the invention is cut from a sheet that is about 0.020 inches to 0.028 inches in thickness or height. A typical thickness is 0.024 inches, which corresponds to a "gauge" of 24. The width of the thread cut for the instant invention is about $1/16^{th}$ inch.

It has now been discovered that the combination of a relatively heavy center with a large gauge thread, of about 0.024±0.004 inches, and having relatively low Swartz modulus, and width of about $1/16^{th}$ of an inch (0.063±0.004 inch), wound to promote an "open" winding pattern under a tension in the range of 700 to 950 grams of tension produces a ball with improvements in player characteristics. Typically, low Swartz modulus is in the range of 160 to 240 p.s.i., and in the preferred embodiment, between 180 to 220 p.s.i. Specifically, the heavy center surrounded by a thread windings layer comprised of a large gauge thread wound to a great circle winding pattern results in a three piece golf ball that spins less than known inventions when it is hit by a driver, while spinning more when it is hit by a pitching wedge. Lower spin off the driver is preferable as it increases the total distance attained from a golf ball.

The use of the relatively large gauge, wide thread, wound to an "open" winding pattern, allows the urethane polymer mixture into which the thread-wound liquid center is placed, to penetrate or seep into the thread windings layer to a greater extent than in the prior art balls. The result is a softer-feeling ball than would be attained otherwise.

The Polyurethane Cover Composition

It has been discovered that a blend of diamine curing agents with slow-reacting prepolymer systems eliminates the problems associated with catalysts while maintaining the advantages associated with slow-reacting prepolymer systems.

Polyurethane compositions comprising the reaction of polyurethane prepolymer and a curing agent are disclosed. The prepolymer comprises a diisocyanate such as Toluene diisocyanate (TDI) and a polyol such as polytetramethylene ether glycol (PTMEG). The curing agent is a blend of a slow-reacting diamine such as dimethylthio 2,4-toluenediamine with a fast-reacting diamine such as diethyl 2,4-toluenediamine, said mixture comprising about 1% to 20% by weight of dimethylthio-2,4-toluenediamine and the balance diethyl-2,4-toluenediamine.

In a preferred embodiment, TDI prepolymer having a low free isocyanate content (low free TDI) is used to reduce adverse effects that can arise from exposure to unreacted isocyanate. The curing agent blend provides flexibility to the formulation by eliminating the need for a catalyst.

The Dimple Configuration

As mentioned previously, in addition to manipulating the center and cover parameters in a golf ball, superior aerodynamic properties are also attributed to the dimple configuration on a golf ball. In the instant invention, the dimples are arranged on the surface of the golf ball based on the geometry of a rhombicosadodecahedron. This configuration is achieved by dividing the outer spherical surface of a golf ball into a plurality of polygonal configurations, including pentagons, squares and triangles for locating a plurality of dimples on the outer surface of the golf ball. The polygonal configurations of this invention are preferably a combination of regular pentagons, squares and triangles to cover the outer surface. This first plurality of polygonal configurations is generally referred to herein as a "rhombicosadodecahedron". The rhombicosadodecahedron is further characterized by a uniform pattern of pentagons formed over the outer surface each bounded by triangles and squares.

A pair of first polygonal configurations, each located on opposite sides of the outer surface, include one of the two poles symmetrically arranged within its boundaries. The outer surface has a plurality of dimples of different sizes. In one embodiment, the dimples are of first, second and third sizes and are generally located to have a first pattern associated with the pentagons, a second pattern associated with the squares, and a third pattern associated with the triangles. Dimples are preferably circular in shape, but can have a non-circular shape within the scope of this invention.

The combination of the aforementioned center, cover, thread windings layer, and dimple specifications produces a golf ball that possesses noticeable improvements in playability with regard to spin and feel while simultaneously being capable of being driven a long distance. The following table, table 2, shows test data results on spin related to thread size.

The liquid center, the cover (55 Shore D polyurethane), and the winding pattern (Great circle) being the same in the following groups, the spin off the 9.5° driver at a ball velocity of 230 feet per second is as shown in Table 2.

TABLE 2

| Thread Size | Spin (RPM) |
|---|---|
| 0.017 × 5/64" | 2720 |
| 0.021 × 1/16" | 2621 |
| 0.024 × 1/16" | 2579 |

DETAILED DESCRIPTION OF THE INVENTION

The golf ball will first be described in its overall aspects, with more details of each component provided later.

Figure 1:
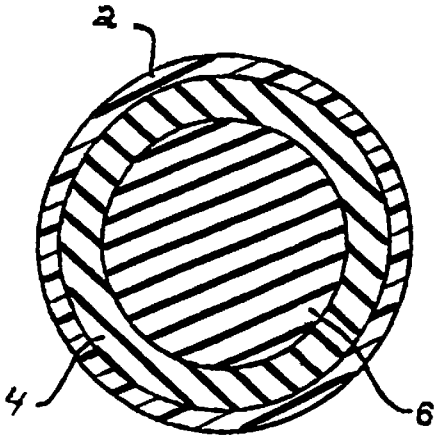
FIG. 1 is a cross sectional view of a three-piece golf ball made in accordance with one embodiment of the invention.

As shown in FIG. 1, the golf ball is comprised of a liquid-filled spherical rubber center 6, a thread windings layer 4, and a cover 2 to make a three-piece golf ball. The liquid-filled rubber center 6 together with the thread windings layer 4 comprise the core of the golf ball. In the preferred embodiment, the golf ball center has a diameter of about between 1.0 inches to 1.25 inches, preferably 1.12 inches, a wall hardness in the range of about 50 Shore A to about 70 Shore A, preferably 60 shore A, and weighs about 17 grams to 19 grams, preferably about 17.9 grams. When combined, the liquid filled rubber center 6 and the thread windings layer 4 measure approximately 1.580 inches in diameter.

The Liquid-Filled Center

The liquid filled rubber center is comprised of a chemical composition well known to those skilled in the art. Except for the choice of a liquid-filled center having the diameter, the wall hardness, and the weight described above, the choice of a particular liquid core forms no part of the invention.

The liquid-filled center used in one embodiment is available from Abbott Laboratories, Ashland, Ohio, and comprises a thick-walled hollow rubber ball in which the center contains a solution formed by dissolving a solid sample, in "pill" form, in water. The solid sample has the following ingredients by weight:

| Percent | Material |
|---|---|
| 47.0 | Polyethylene oxide |
| 1.60 | Fumed silica |
| 0.01 | Ammonia |
| 0.01 | Ethylamine |
| 0.002 | Ethylene oxide |
| 0.50 | Calcium as mixed salts |
| 0.05 | Butylated hydroxytoluene |
| 49.5 | Sucrose |
| 1.0 | Stearic acid |

Specifically, the center may have a weight in the range of 17 grams to 19 grams, preferably about 17.9 grams.

The Thread Windings Layer

The thread windings layer 4 is comprised of thread cut from sheets of polyisoprene rubber and/or natural rubber and their blends thereof. The unstressed (unwound) thread dimensions are preferably 0.024 inches thickness or height and a thread width of about 1/16th inch. The thread has a Swartz modulus between 160 p.s.i. and 240 p.s.i. The thread windings are wound in an open great circle pattern with a thread tension from about 700 grams to 950 grams, to a thread winding thickness of between 0.20 inches to 0.26 inches, preferably about 0.23 inches.

The windings layer of the instant invention has a lower density than is found in other polyurethane golf balls. Specifically in the preferred embodiment, the unstressed dimensions for thread used in the windings of the golf ball are about 0.020 inches to about 0.028 inches in height, preferably about 0.024 inches, with a width of about 0.059 to about 0.067 inches and preferably 1/16th of an inch. In contrast to a gauge of 24, corresponding to 0.024 inches, the gauge of threads used in other windings is smaller, 17, or 0.017 inches. Advantageously, the use of a large gauge (about 24) thread in the winding layer produces a golf ball that spins less off the driver when compared to a golf ball produced with a smaller gauge (17) thread. This decrease in spin when the instant ball is hit by a driver occurs as a consequence of the novel construction of a heavy center combined with a thread winding layer that has threads with a lesser density. The larger gauge used for the threads in the thread windings layer results in a golf ball that has a more "open" pattern for the windings. The winding pattern used is a great circle (Huestis) pattern that is well known to those skilled in the art. Advantageously, this second design feature for the windings with regard to the "open" winding pattern allows more reactive urethane to penetrate into the core of the golf ball during its manufacture.

The winding conditions for the thread windings layer also contribute significantly to the novel character of the instant ball. In particular, the tension under which the thread is wound affects the PGA compression of the resultant golf ball. In the preferred embodiment, the golf ball is wound at a tension in the range of about 700 grams of tension to about 950 grams of tension, preferably, 825 grams of tension. This winding tension produces a golf ball with compression in the range of 70 PGA to 100 PGA, preferably 85 PGA. A compression in this range resulting from the unique character of the thread windings layer, coupled with the heavy center produces a golf ball that is able to maintain great distance and carry while simultaneously having a flight path with a lower trajectory. Advantageously, a lower trajectory in the flight path causes the golf ball to land at an acute angle to the ground. In turn, this acute landing promotes more roll, and thus the golf ball will travel a greater distance when it hits the ground.

The Cover

The cover 2 has a thickness of about 0.050 inches and a hardness of about 46 Shore D to about 54 Shore D, preferably 50 shore D.

With regard to the instant invention's ability to spin more and have superior shot-making feel when hit by a pitching wedge, this improvement in playability is attributed to the softer polyurethane cover—i.e. about 50±4 Shore D. As is known in the art, when a pitching wedge hits a ball, the impact force is less than when a driver hits a golf ball. Because less impact force is used, the cover plays a more integral part in the performance of the ball. Consequently the composition and construction of the ball's cover is critical to the ball's shorter iron playability characteristics. Spin affects the ball's performance. More spin, attributed to the softer polyurethane cover, causes the ball to have greater "bite," especially into a green, when hit with a pitching wedge. In turn, greater "bite" gives a player more control over the ball's performance when shooting into a green.

The Polyurethane Composition of the Cover

As is well known in the art, polyurethane can result from a reaction between an isocyanate-terminated polyurethane prepolymer and a curing agent. The polyurethane prepolymer is produced when a diisocyanate is reacted with a polyol. The prepolymer is then reacted with the curing agent. The curing agent can be either a diamine, a polyol, or a blend of the two. Production of the prepolymer before addition to the curing agent is known as the prepolymer process. In what is known as a one-shot process, the three reactants, diisocyanate, polyol and curing agent are combined in one step. Of the two processes, the prepolymer process is preferred since it allows for greater control over the reaction. Nevertheless, golf balls in accordance with the present invention can be produced using either process.

Of notable importance to the present invention is the variety of curing agents that have been previously used to produce urethane elastomers. For example, the curing agents disclosed in the '673 patent are slow-reacting polyamines or polyols. As described in the '673 patent, slow-reacting polyamines are diamines that have amine groups which are sterically and/or electronically hindered by electron withdrawing groups or bulky groups situated proximate to the amine reaction sites. The spacing of the amine reaction sites will also affect the reactivity speed of the polyamines.

When slow-reacting polyamines are used as the curing agent to produce urethane elastomers, a catalyst is typically needed to promote the reaction between the urethane prepolymer and the curing agent. Unfortunately, as is well known in the art, the use of a catalyst can have a significant effect on the ability to control the reaction and thus, on the overall processibility.

To eliminate the need for a catalyst, a fast-reacting curing agent can be used. Such fast-reacting curing agents, e.g., diethyl-2,4-toluene diamine, do not have electron withdrawing groups or bulky groups that interfere with the reaction groups. However, the problem with lack of control associated with the use of catalysts is not completely eliminated since fast-reacting curing agents are also relatively difficult to control.

It has been discovered that a blend of a slow-reacting curing agent and a fast-reacting curing agent eliminates the problems associated with using either type of curing agent in isolation. The ultimate result of such a combination is the realization of greater control and concomitant flexibility over the reactions used to produce urethane elastomers.

In accordance with the present invention, the curing agents used are dimethylthio-2,4-toluenediamine and diethyl-2,4-toluenediamine, said mixture comprising about 1%--20% by weight of dimethylthio-2,4-toluenediamine and the balance diethyl-2,4-toluenediamine. The curing agent dimethylthio-2,4-toluenediamine is known under the commercial name of Ethacure® 300. The molecular weight of the dimethylthio-2,4-toluenediamine curing agent is 214.0 grams/mole. The curing agent diethyl-2,4-toluenediamine has two commercial grades names, Ethacure® 100 and Ethacure ®100LC. The Ethacure ®100LC commercial grade has lower color and less by-product. In other words, it is considered a cleaner product to those skilled in the art. Advantageously, the use of the Ethacure ® 100LC commercial grade results in a golf ball that is less susceptible to yellowing when exposed to UV light conditions. A player appreciates this desirable aesthetic effect. It should be noted that the instant invention may use either of these two commercial grades for the curing agent diethyl-2,4-toluenediamine. The curing agents are sold by the Albermarle Corporation. The molecular weight for diethyl-2,4-toluenediamine is 178.28 grams/mole. The chemical structure for the curing agents is substantially as shown below:

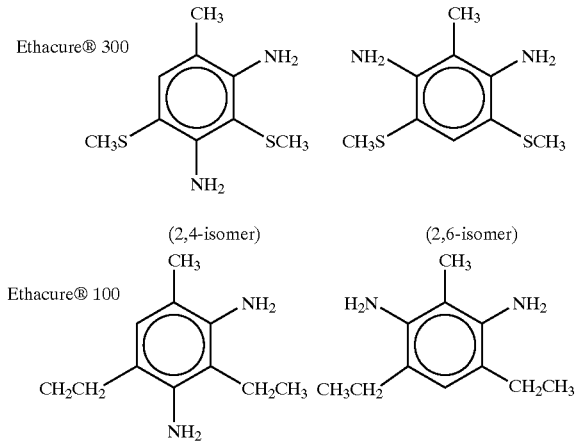

One advantage that warrants immediate mention is the elimination of a post cure period. One of the major drawbacks with prior systems is the requirement for a post cure period during which other components of a golf ball can be detrimentally affected by the curing process. For example, it is not unusual for golf balls made with known polyurethane systems to require a post cure at temperatures exceeding 140° F. for over eight hours. Three-piece golf balls with rubber windings exhibit reduced compression when exposed to such "high temperature" post cure conditions. Specifically, when rubber windings are used in three-piece golf balls, long exposure to high heat leads to relaxation of the windings or thread and hence reduction in compression values and initial velocity. With the curing agent blend of the present invention, the problems associated with a post cure period are effectively eliminated.

With respect to the diisocyanate component, it is well known in the golf ball industry that toluene diisocyanate (TDI) provides additional processing flexibility to the system unlike any other diisocyanate tested. For example, when 4,4'-diphenylmethane diisocyanate (MDI) is used, the ratio tolerances (prepolymer-to-curing-agent ratio) are much less flexible compared to when TDI is used. Unless strict ratios are adhered to, urethane polymers made with MDI will not have the desired end properties, such as hardness and compression.

A still further problem with MDI is that it reacts much faster when reacted with an amine curing agent than does TDI. Thus, some of the control achieved by using the aforementioned curing agent blend is lost when MDI is used.

An additional disadvantage with an MDI-based system is the need for an elevated curing temperature even though a post-cure period is eliminated by the curing agent blend. Although MDI-based systems can be cured at room temperature by using curing agents such as Polamine7 (Polaroid Corporation), the system is cost prohibitive. Polamine7 costs as much as four times the equivalent amount of the curing agents used in the present invention. This renders the use of Polamine7 much less cost effective.

In contrast, a TDI-based system is essentially a low-cost "room temperature cure system" in that once the TDI-based polyurethane prepolymer is reacted with the curing agent blend, the composition can be cured at room temperature. This prevents any adverse effects an elevated curing temperature could have on the threading and/or core of the golf ball being produced.

Accordingly, in order to maximize the reaction control obtained by using the curing agent blend, TDI has proven to be the best choice for the diisocyanate component. A TDI-based polyurethane system not only complements but also enhances the slow reacting system achieved using the curing agent blend. The molecular weight of the toluene diisocyanate is 176.0 grams/mole. TDI is commercially available in two different blends of the 2,4- and 2,6-isomer. The two blends are 60:40 and 80:20. The structures of the 2,4- and 2,6-isomers of TDI are provided below:

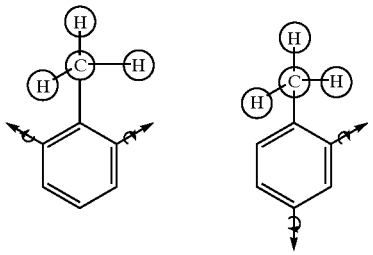

TDI

A similar situation was discovered when selecting the polyol component. For the slow curing system of the present invention, the preferred polyol is polytetramethylene ether glycol (PTMEG). Like urethane elastomers made with other ether polyols, urethane elastomers made with PTMEG exhibit good hydrolytic stability and good tensile strength. Hydrolytic stability allows for a golf ball product that is substantially impervious to the effects of moisture. Thus, a golf ball made with a polyurethane system that has an ether glycol for the polyol component will have a longer shelf life, i.e., retains physical properties under prolonged humid conditions.

Unlike urethane elastomers made with other ether polyols, e.g., polypropylene ether glycol, urethane elastomers made with PTMEG exhibit superior dynamic properties such as coefficient of restitution (COR) and Bashore rebound. The polyurethane-polyurea chemical links that are formed, when PTMEG is used with a diamine curing agent, provide good thermal stability under elevated temperatures. As a result, hardness stability can be achieved. The polyol used in accordance with the present invention has a molecular weight in the range of 948 grams/mole to 1448 grams/mole. Advantageously, the use of a polyol with this molecular weight results in a softer polymer golf ball cover. PTMEG is sold by DuPont, and is substantially as shown below.

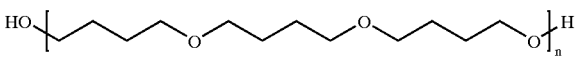

PTMEG (n = 4 to 7)

The polyurethane compositions of the invention are prepared by reacting a prepolymer of a diisocyanate and a polyol. The prepolymer must have a NCO % content of between 4.0% and 6.0% by weight of the prepolymer. Preferably the NCO % content is about 5% by weight.

The instant golf ball is manufactured according to either a compression molding or injection molding process. To produce a golf ball in accordance with the invention, in a preferred embodiment, 100 PPHR of prepolymer (low free TDI @ 5% NCO and PTMEG) is heated to 140° F. in a vat. 13.2 PPHR of a curative comprising diethyl-2,4-toluenediamine (i.e. Ethacure® 100 or Ethacure® 100 LC) and dimethylthio-2,4-toluenediamine-(i.e. Ethacure® 300) at a 97.57:2.43 ratio is maintained at room temperature (approximately 72° F.) in second vat. The contents of the first and second vats are mixed in mixer along with 2.3 PPHR pigment from a third vat. The resultant mixture is poured into a hemispherical cavity of first open mold half that has a diameter of about 1.68 inches. As discussed later, in an alternative embodiment, just the diethylthio-2,4-toluenediamine curative may be used.

Shortly after the first open mold half is filled with the polyurethane mixture, a second hemispherical cavity situated in a second open mold half is filled with the polyurethane mixture. The second mold half also has a diameter of about 1.68". The polymer mixture in each mold half will reach a semi-gelled state after about 35 seconds from the time when it was poured into the mold half. After the polymer mixture in the first mold half has reached a semi-gelled state, a golf ball core comprising a liquid-filled spherical center with thread windings is lowered into the first mold half containing "semi-gelled" polyurethane. The semi-gelled polymer mixture in the first mold half is allowed to contact and to penetrate the thread windings layer of the core that has been inserted into the first mold half. After approximately 20–30 seconds, the first mold half is inverted and mated with the second mold half containing polyurethane mixture which has also reached a semi-gelled state. The combination of the polyurethane mixture in each of the mold halves forms the golf ball cover. The mated first and second mold halves containing the polymer mixture and golf ball core are next heated for approximately 4 minutes and then cooled for approximately three minutes. The golf ball is then removed from the mold, and allowed to post cure at room temperature for 8–16 hours.

As discussed, if desired other ingredients, such as pigments, can be added to the mixture. For example, a pigment addition of 0.25–5% by weight of the total polyurethane prepolymer/curative mixture can be added via a third stream to the mixhead at the time of adding the prepolymer and the diamine curing agent to produce the desired color. In a preferred embodiment, the pigment shall consist of 65% $TIO_2$ and 35% carrier (typically a polyol, with or without toners) by weight. The pigment may or may not include other additives including an UV stabilizing package, optical brighteners, etc.

To achieve the desired results, the reactants should be reacted to obtain a stoichiometry of between about 92–105% and preferably 95%. With respect to the NCO % content, any prepolymer used should have a NCO % between about 4.0–6.0% by weight of the prepolymer and preferably about 5.0% by weight. Systems using TDI, IPDI (Isophorone diisocyanate) or MDI as the diisocyanate and an ether backbone are all possible choices for the polyurethane prepolymer. The polyol selected should have a molecular weight of between about 650 grams/mole to 3000 grams/mole, and preferably between about 948 grams/mole to 1448 grams/mole. The larger the molecular weight, the softer, and more flexible the polyurethane becomes.

The curative should be a blend of a slow-reacting diamine and a fast-reacting diamine. As stated previously, in a preferred embodiment, one of two commercial grades of a fast-reacting diethyl-2,4-toluenediamine sold under the trade name Ethacure® 100 and Ethacure® 100LC respectively by Albermarle, and a slow-reacting dimethylthio-2,4-toluenediamine sold under the trade name Ethacure® 300 by the Albermarle Corporation, are combined at a ratio of between about 99:1–80.20. This produces polyurethanes having desirable physical properties with respect to softness and spin. In addition, the use of a small amount of Ethacure® 300 in the curative system has other beneficial effects. These include a slightly lower cover green strength at the time of de-molding, and slightly longer gel time prior to insertion of the wound cores.

However, in an alternative embodiment, the curative system may consist of only the fast-reacting diethyl-2,4-toluenediamine. The advantage of eliminating the dimethylthio-2,4-toluenediamine is that one diminishes the yellowing of the golf ball under UV light conditions. That is an undesirable aesthetic effect associated with the Ethacure® 300 curing agent.

As previously discussed, it is not essential that a blend of the two curative agents be used to eliminate the need for a catalyst. It has been discovered that the reaction will proceed more slowly when the prepolymer has a relatively low NCO content of about 5% and when the PTMEG component of the prepolymer has a molecular weight in the range of about 948 grams/mole to 1448 grams/mole. In turn, the greater control over the prepolymer process attributed to both the lower NCO content and this PTMEG polyol allows one to use only the fast-reacting diethyl-2,4-toluenediamine curing agent in either of its commercial grades, Ethacure® 100 LC or Ethacure® 100. Advantageously, in this alternative embodiment, the reaction can take place without the need of a catalyst while still achieving good gel times (a pot life of approximately 40–70 seconds).

If a "room temperature cure" formulation is desired, catalysts, such as Dabco 33 LV from Air Products, are not suitable since they provide exponential exothermic reactions. With few exceptions, once a catalyst is introduced into a urethane system, it is difficult, and, from a commercially practical standpoint, impossible to obtain a desired slow exothermic reaction. Without being able to control the temperature pattern of the reaction, it is difficult to obtain the desired physical properties since the physical properties are temperature sensitive. The curing agent blend of the present TDI-based system provides the desired exothermic reaction so that the targeted end-product physical properties can be achieved.

A further surprising advantage of the new system using the Ethacure 100/300 blend is the elimination of a heated post-cure without losing the benefits of a post-cure period. With many prior art systems, compression is lost if a "high temperature" post-cure period is instituted. With the system of the present invention, good compression numbers can be achieved without a "high temperature" post-cure period. Moreover, curing can be performed at room temperature, i.e., 72° F.

The polyurethane made with the curing agent blend could be cured without the need for a "high temperature" post cure period or "extended cure" period during which golf ball physical properties can be lost due to the exposure of the other golf ball components, e.g. windings and center, to high temperatures for long periods of time. By using the curing agent blend of the invention, with the elimination of a "high temperature" post cure period, physical properties such as initial velocity and compression can be maintained while achieving "full" reaction of the polyurethane reaction components.

A still further surprising advantage of the preferred curing agent blend is the flexibility in formula concentrations the new system provides. To change the resulting characteristics, one need only change the concentrations of the reactants. For example, hardness readings ranging from 50 D–65 D have been achieved by altering the molecular weight of the polyol component (PTMEG in the preferred embodiment), the NCO % content and/or the stoichiometry of the reaction. Even when the reactant concentrations are altered to achieve different hardness levels, good physical properties can be achieved within a range of alterations. Specifically, in the preferred embodiment, the lower NCO % content of 5% and the use of a longer polyol component results in a finished polymer cover that has a hardness in the range of about 46 Shore D to 54 Shore D, preferably 50 Shore D.

Depending on the amount of time needed to pour a particular number of golf ball molds with a single batch of the polyurethane prepolymer mix, a curing agent blend can be picked that will accommodate the speed requirements of the golf ball manufacturing process without having any appreciable effect on the physical characteristics of the end product.

A yet further advantage, as is well known in the golf ball manufacturing industry, is that the ratio of prepolymer to curing agent is also more forgiving than other known systems. In contrast, for example, the system disclosed in the '673 patent requires the ratio to be more "exact" in order to produce the desired polymer.

Advantageously, a polyurethane material having superior processibility can be achieved that exhibits "high" elongation, tensile strength and tear strength. When used as the material for a golf ball cover, these physical properties translate into a golf ball cover material that exhibits superior cut, abrasion and shear resistance versus ionomers and balata when struck by hard objects such as the grooved face of a golf club head.

As discussed previously, there is a great deal of flexibility that can be built into the urethane elastomer system. The curing agent blend ratio can be modified to alter the speed of the reaction to accommodate the practitioner's needs while the diisocyanate NCO % content can be varied to achieve varying physical properties. No other golf ball specific urethane elastomer system is known by the inventors that provides such flexibility.

The Dimple Pattern of the Cover

Turning now to the dimple technology employed in the instant invention, as was discussed previously, the manipulation of the dimple configuration also yield a golf ball with improved characteristics of play. As stated previously, the preferred geometry is a rhombicosadodecahedron. Accordingly, the scope of this invention provides a golf ball mold whose molding surface contains a uniform pattern to give the golf ball a dimple configuration superior to those of the art. The invention is preferably described in terms of the golf ball that results from the mold, but could be described within the scope of this invention in terms of the mold structure that produces a golf ball.

To assist in locating the dimples on the golf ball, the golf ball of this invention has its outer spherical surface partitioned by the projection of a plurality of polygonal configurations onto the outer surface. That is, the formation or division that results from a particular arrangement of different polygons on the outer surface of a golf ball is referred to herein as a "plurality of polygonal configurations." A view of one side of a golf ball 5 showing a preferred division of the golf ball's outer surface 7 is illustrated in FIG. 2.

In the preferred embodiment, a polygonal configuration known as a rhombicosadodecahedron is projected onto the surface of a sphere. A rhombicosadodecahedron is a type of polyhedron which contains thirty (30) squares, twenty (20) polyhedra of one type, and twelve (12) polyhedra of another type. The term "rhombicosadodecahedron" is derived from "dodecahedron," meaning a twelve (12) sided polyhedron; "icosahedron," meaning a twenty (20) sided polyhedron, and "rhombus" meaning a four sided polyhedron.

Figure 2:
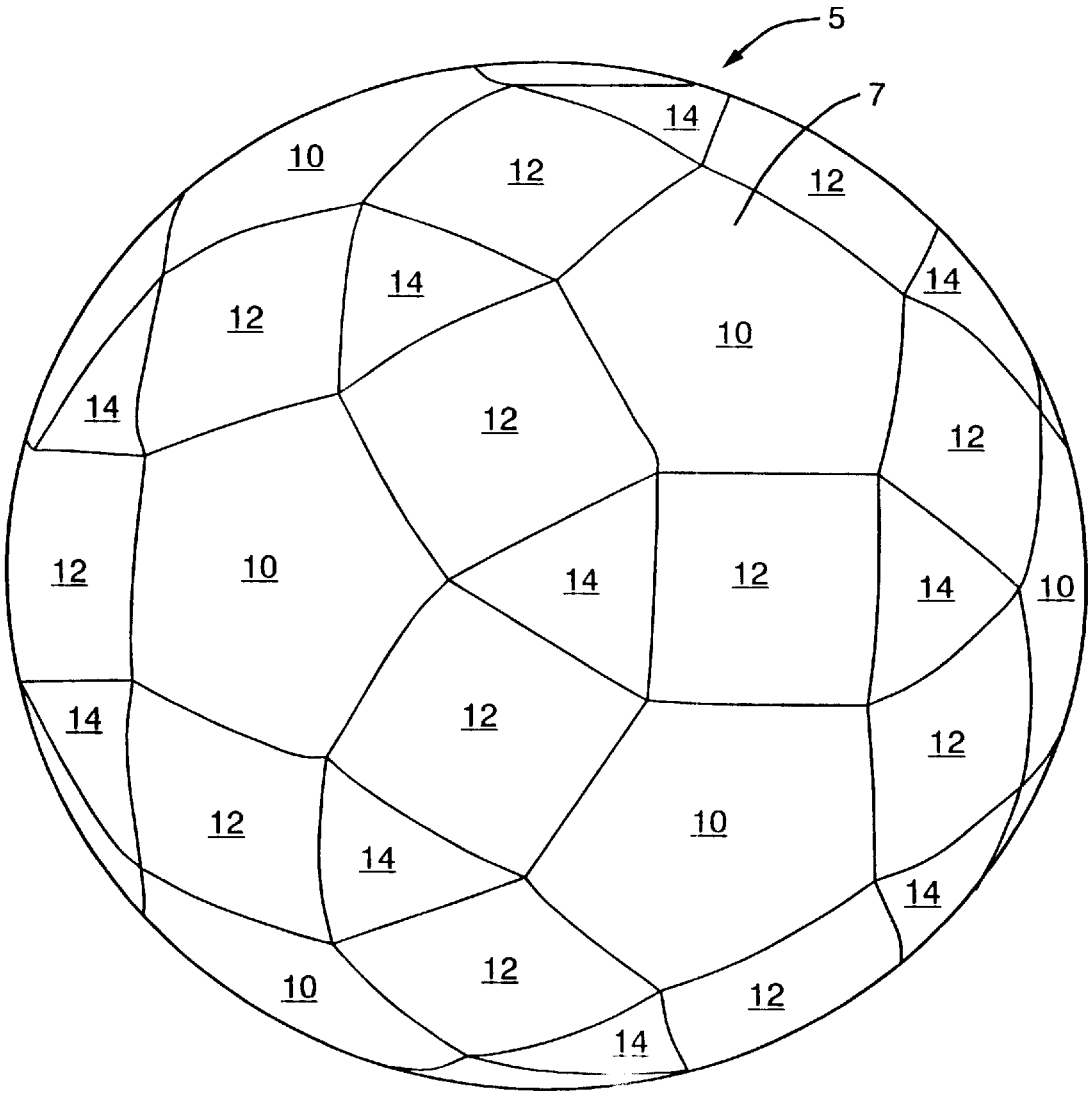
FIG. 2 is an elevation view of the outer surface of a golf ball being divided into a plurality of polygonal configurations according to the invention.

The rhombicosadodecahedron of the preferred embodiment is comprised of thirty (30) squares 12, twelve (12) pentagons 10, and twenty (20) triangles 14, as shown in FIG. 2. It has a uniform pattern of pentagons with each pentagon bounded by triangles and squares. The uniform pattern is achieved when each regular pentagon 10 has only regular squares 12 adjacent to its five boundary lines, and when a regular triangle 14 extends from each of the five vertices of the pentagon. Five (5) squares 12 and five (5) triangles 14 form a set of polygons around each pentagon. Two boundary lines of each square are common with two pentagon boundary lines, and each triangle has its vertices common with three pentagon vertices.

The outer surface of the ball is further defined by a pair of poles and an uninterrupted equatorial great circle path around the surface. A great circle path is defined by the intersection between the spherical surface and a plane that passes through the center of the sphere. (An infinite number of great circle paths may be drawn on any sphere.) The uninterrupted equatorial great circle path in the preferred embodiment corresponds to a mold parting line, which separates the golf ball into two hemispheres. The uninterrupted great circle path is described as uninterrupted because it has no dimples on it. The mold parting line is located from the poles in substantially the same manner as the equator of the earth is located from the north and south poles.

Figure 3:
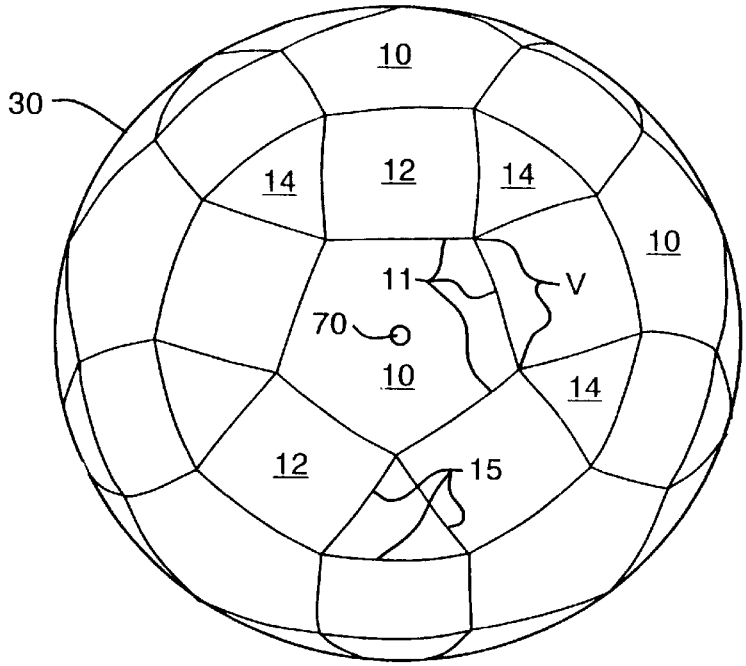
FIG. 3 is an elevation view of the golf ball of this invention showing the relative locations of pentagons, squares and triangles formed on the outer surface with a pole at the center of a pentagon.
Figure 4:
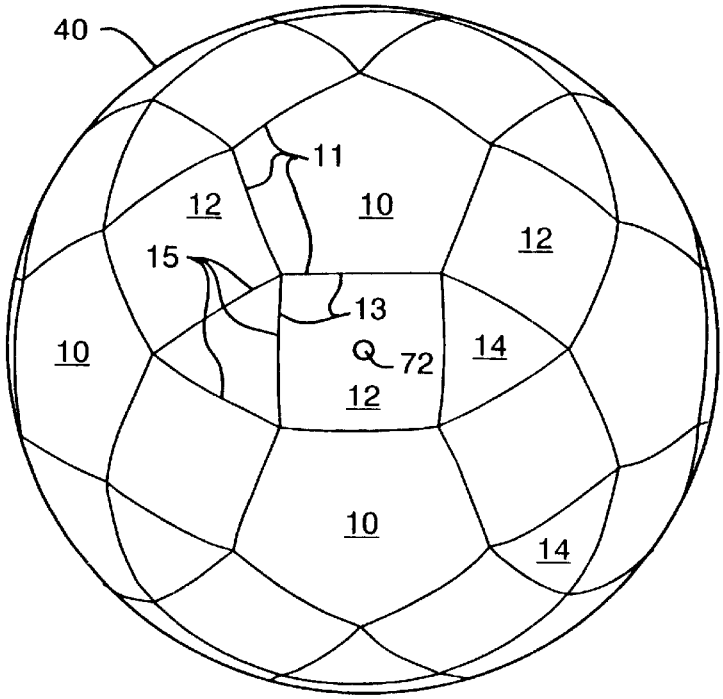
FIG. 4 is an elevation view of the golf ball of this invention showing the relative locations of pentagons, squares and triangles formed on the outer surface with a pole at the center of a square.
Figure 5:
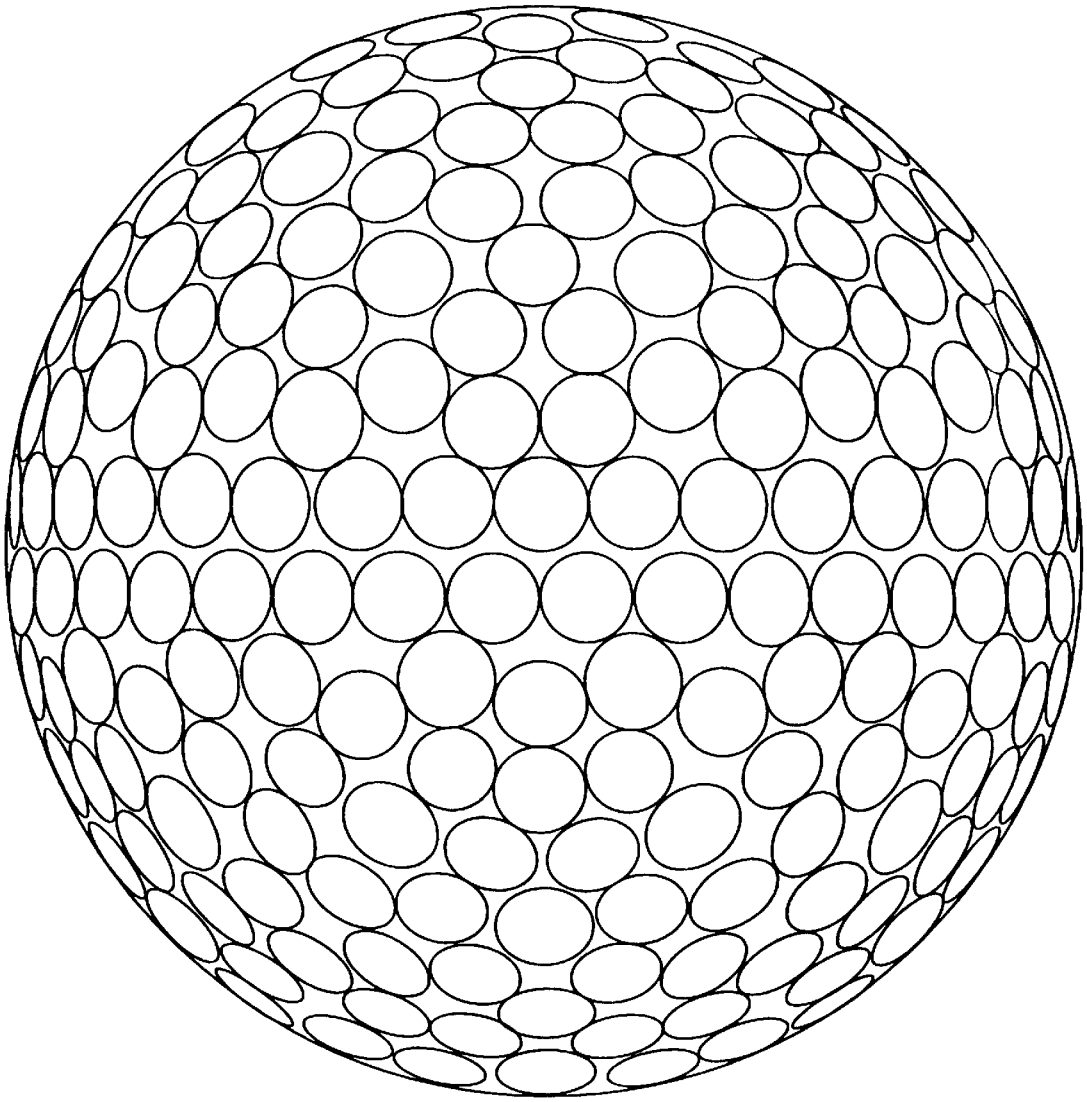
FIG. 5 is an equatorial view of the ball of preferred embodiment of the instant invention.
Figure 6:
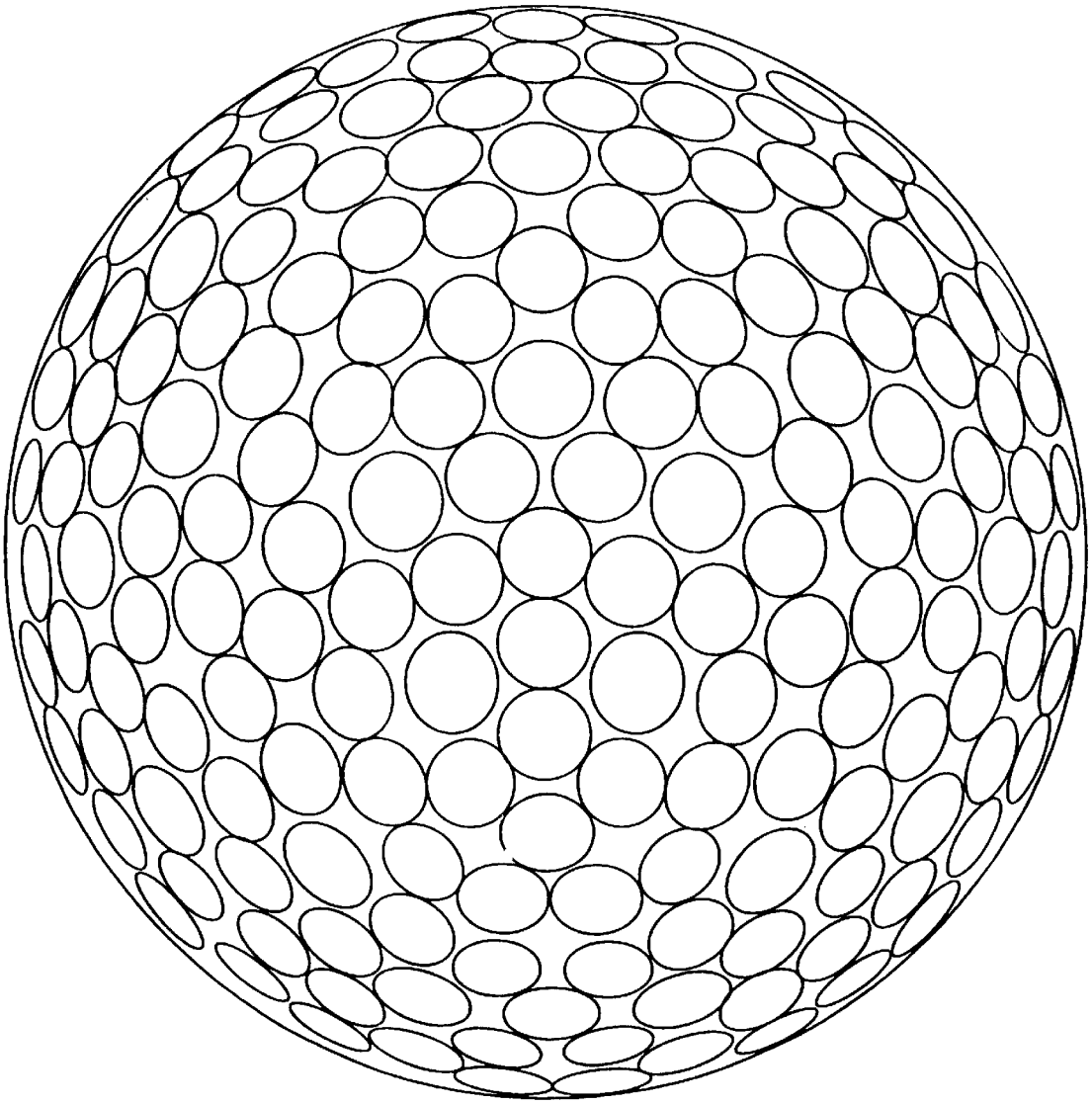
FIG. 6 is a polar view of the ball shown in FIG. 5.
Figure 7:
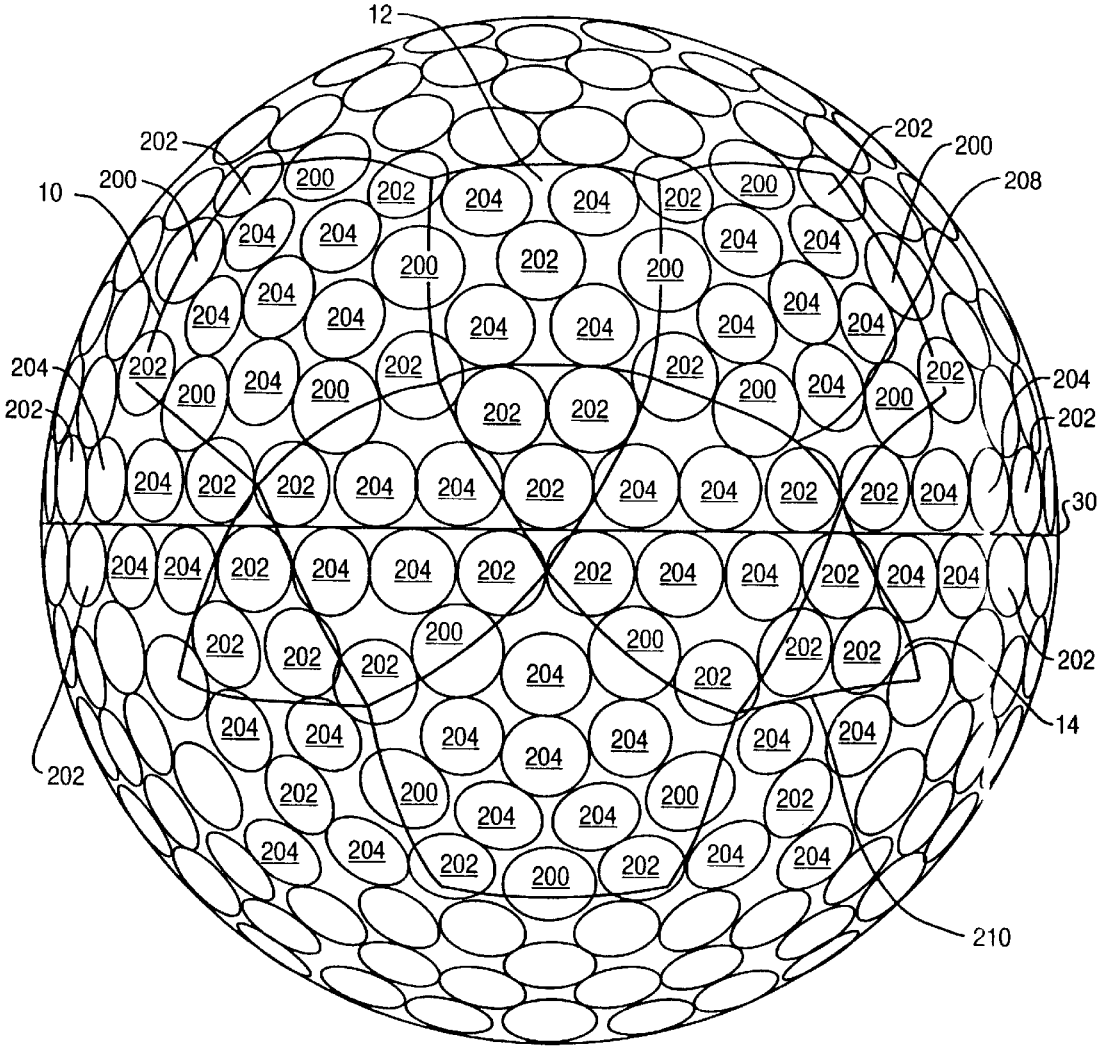
FIG. 7 is an equatorial view of the ball shown in FIG. 5, and includes the polygons projected thereon.
Figure 8:
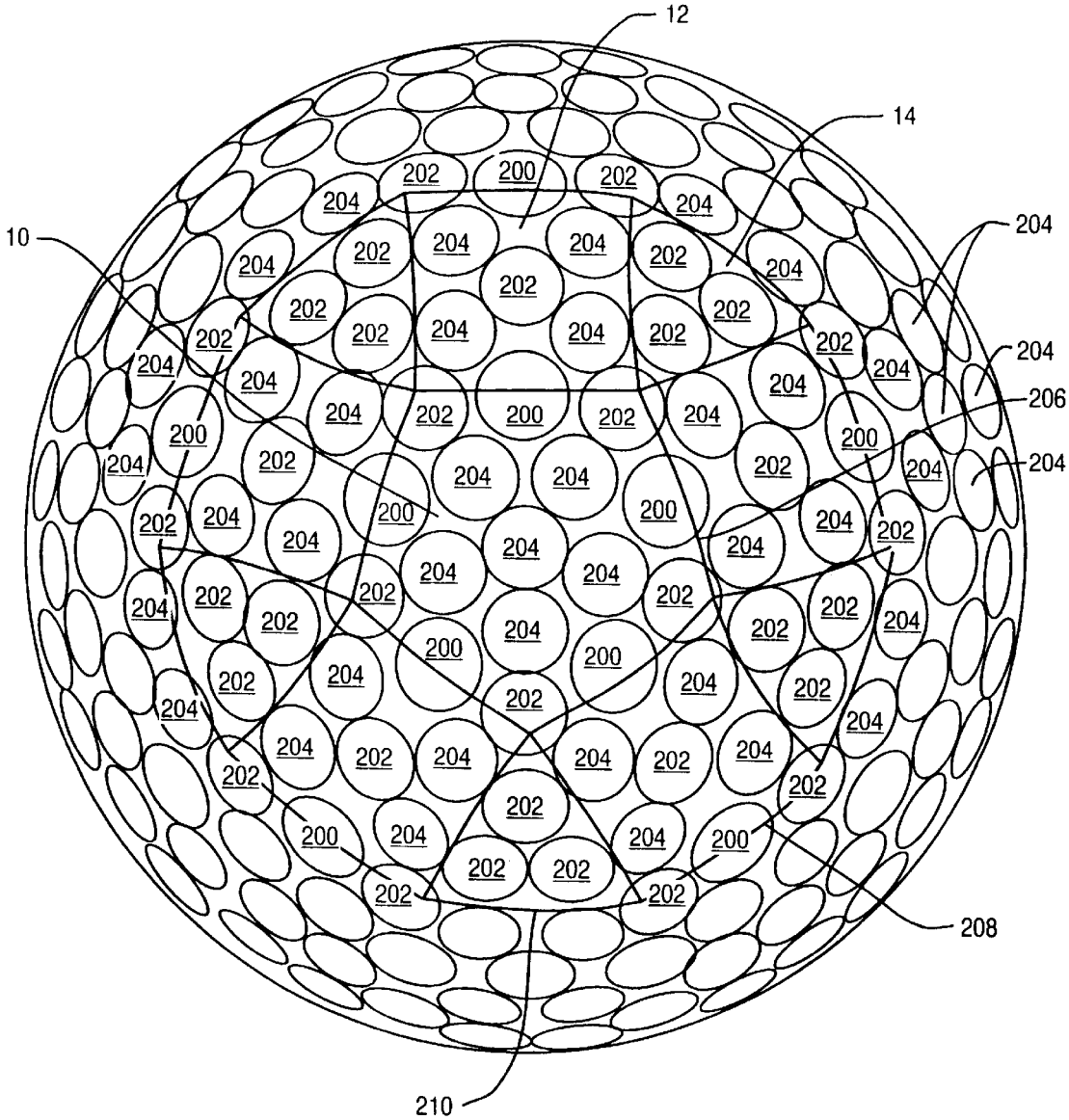
FIG. 8 is a polar view of the ball shown in FIG. 6 and includes polygons projected thereon.

Referring to FIG. 3, the poles 70 are located at the center of a pentagon 10 on the top and bottom sides of the ball, as illustrated in this view of one such side. The mold parting line 30 is at the outer edge of the circle in this planar view of the golf ball. In the embodiment shown in FIG. 4, the poles 72 are both located at the center of the square on the top and bottom of the golf ball, as illustrated in this view of one such side. (The top and bottom views are identical.) The mold parting line 40 is at the outer edge of the circle in this planar view of the golf ball.

Dimples are placed on the outer surface of the golf ball based on segments of the plurality of polygonal configurations described above. In the preferred embodiment, three (3) dimples are associated with each triangle, five (5) dimples are associated with each square, and sixteen (16) dimples are associated with each pentagon. The term "associated" as used herein in relation to the dimples and the polyhedra means that the polyhedra are used as a guide for placing the dimples.

In the preferred embodiment, there are a total of 402 dimples. Advantageously, this decrease in the number of dimples when compared to prior art golf balls results in a geometrical configuration that contributes to the aerodynamic stability of the instant golf ball. Aerodynamic stability is reflected in greater control over the movement of the instant golf ball.

The dimple configuration of the preferred embodiment is shown in FIGS. 5–8. It is based on the projection of the rhombicosadodecahedron shown in FIG. 3. The ball has a total of 402 dimples. The plurality of dimples on the surface of the ball are selected from three sets of dimples, with each set having different sized dimples. Dimples 200 are in the first set, dimples 202 are in the second set, and dimples 204 are in the third set. Dimples are selected from all three sets to form a first pattern associated with the pentagon 10. All sides 206 of each pentagon are intersected by two dimples 200 from the first set of dimples and one dimple 202 from the second set of dimples. All pentagons 10 have the same general first pattern arrangement of dimples.

Dimples 200, 202 and 204 (from all three sets of dimples) are also used to form a second pattern associated with the squares 12. All sides 208 of each square 12 are intersected by dimples 202 from the second set of dimples, and all squares have the same general second pattern arrangement of dimples.

Dimples 202 from the second set of dimples form a third pattern associated with the triangles 14. All sides 210 of each triangle are intersected by a dimple 202 from this second set of dimples. All triangles have this same general third pattern arrangement of dimples. The mold parting line 30 is the only dimple free great circle path on this ball.

Advantageously, the use of a single uninterrupted mold parting line leads to superior aerodynamic properties in the instant golf ball. The single mold parting line results in less severe separation between the dimples, i.e. less "bald spots" on the surface of the ball. This in turn increases the effectiveness of the dimples on the golf ball. Advantageously, increasing the effectiveness of the dimples by reducing the land area on the surface of the golf ball improves the aerodynamic properties of the instant golf ball with regard to distance and control.

Figure 9:
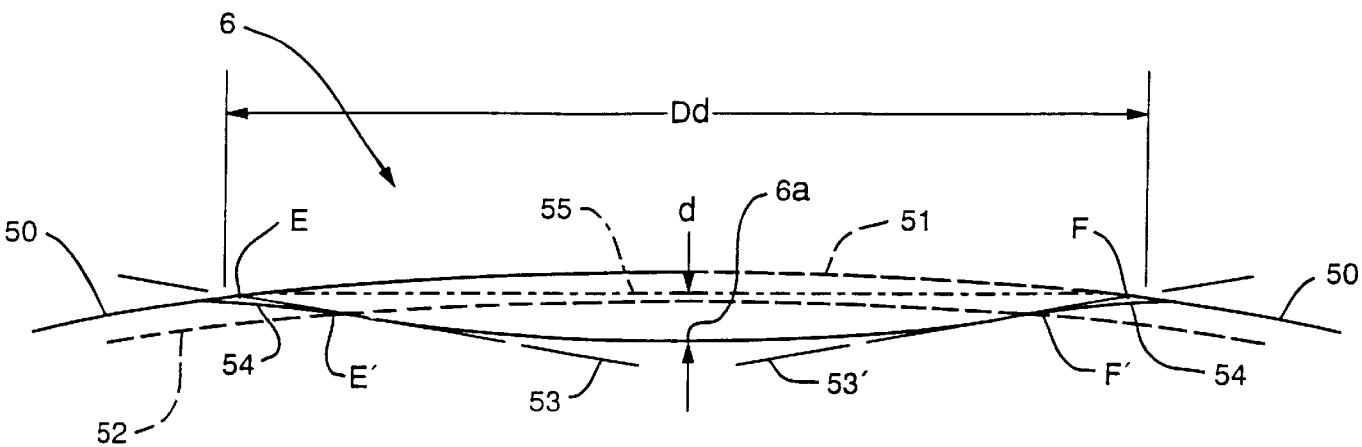
FIG. 9 is a cross sectional view cut through one of the dimples on the outer surface of the ball.

A single radius (Radius 1) describes the entire shape of the dimple. Dimple size is measured by a diameter and depth generally according to the teachings of U.S. Pat. No. 4,936,587 (the '587 patent), which is included herein by reference thereto. An exception to the teaching of the '587 patent is the measurement of the depth, which is discussed below. A cross-sectional view through a typical dimple 6 is illustrated in FIG. 9. The diameter Dd used herein is defined as the distance from edge E to edge F of the dimple. Edges are constructed in this cross-sectional view of the dimple by having a periphery 50 and a continuation thereof 51 of the dimple 6. The periphery and its continuation are substantially a smooth surface of a sphere. An arc 52 is inset about 0.003 inches below curve 50-51-50 and intersects the dimple at point E' and F'. Tangents 53 and 53' are tangent to the dimple 6 at points E' and F' respectively and intersect periphery continuation 51 at edges E and F respectively. The exception to the teaching of '587 noted above is that the depth d is defined herein to be the distance from the chord 55 between edges E an F of the dimple 6 to the deepest part of the dimple cross sectional surface 6(*a*), rather than a continuation of the periphery 51 of an outer surface 50 of the golf ball.

In the preferred embodiment, dimples 200 from the first set have a diameter of 0.156 inches; dimples 202 from the second set have a diameter of 0.145 inches, and dimples 204 from the third set have a diameter of 0.142 inches. Dimples 200 have a depth of 0.0080 inches. Dimples 202 have a depth of 0.0078 inches. Dimples 204 have a depth of 0.0076 inches. All dimples 200, 202, and 204 are single radius in cross section.

Advantageously, the use of dimples that are single radius in cross section improves the performance of the instant golf ball with respect to both distance and control of the movement of the golf ball given the high spin rate of the instant high performance three-piece ball. The presence of single radius dimples allows for a soft trajectory in the golf ball's flight on iron shots. In turn, this soft trajectory leads to a soft entry of the golf ball onto the golf course green, which in turn results in greater control over the movement of the instant golf ball. Remarkably, the single radius provides a boring trajectory during driver shots.

The radius (radius 1) for dimples 200 in the preferred embodiment is about 0.7874 inches, the radius for dimples 202 is about 0.3325 inches, and the radius for dimples 204 is 0.3191 inches. However, it is understood that the following dimple size ranges are within the scope of this invention. Dimples 200 from the first set may have a diameter in the range of 0.154 inches to 0.158 inches; dimples 202 from the second set may have a diameter in the range of 0.142 to 0.147 inches; dimples 204 from the third set may have a diameter in the range of 0.140 to 0.144 inches and the radius may be in the range of 0.3150 to 0.3850 inches.

An Example of Making a Preferred Embodiment

To prepare a golf ball of the invention, provide a liquid-filled rubber sphere as described above; freeze the rubber sphere in order to solidify the liquid center. The liquid-filled rubber sphere becomes and is the center; and when wrapped, becomes the core. Wrap the frozen rubber sphere, ie., the center, with thread windings in an open great circle pattern with a thread tension from about 700 grams to 950 grams, to a thread winding thickness of between 0.20 inches and 0.26 inches, wherein the thread windings have an unstressed thread dimension of about $1/16^{th}$ of an inch width by about 0.020 inches to 0.028 inches height, a Swartz modulus between 160 to 240 p.s.i. Provide a polymer mixture as described above. Provide a golf ball mold comprising a first mold half and a second mold half, the interior mold surface containing a uniform pattern to give the surface of the golf ball a dimple configuration according to the invention as described above. Pour the polymer mixture into the first mold half Pour the polymer mixture into the second mold half. Allow the mixture in the first mold half to reach a semi-gelled state. It will take approximately 35 seconds for the mixture to reach a semi-gelled state. Lower the core, ie., liquid-filled rubber center with thread windings, into the semi-gelled polymer mixture in the first mold half such that the liquid-filled rubber center with thread windings is suspended in the semi-gelled polymer mixture. Allow the semi-gelled polymer mixture to penetrate the thread windings for about 20 to 30 seconds. Invert the first mold half and mate it to the second mold half. Heat the mated first and second mold halves containing the polymer mixture and the rubber center with thread windings for about 4 minutes. Cool the mated first and second mold halves containing the polymer mixture and the rubber center with thread windings for about three minutes. Removing the molded golf ball from the first and second mold halves and allowing the golf ball to cure at room temperature for 8 to 16 hours.

The Unique Combination

As was discussed previously, the improvements in ball performance of the invention are due to the combination of changes in the center weight, the size and winding conditions of the thread, the cover material, and the dimple pattern of the golf ball. In the invention, the novel manipulation of these parameters creates a ball that spins less and travels further when hit by a driver, while being able to spin more and have superior shot-making feel when hit by a pitching wedge. These two desirable playability characteristics are possible in the instant golf ball due to the unique construction of this ball.

As is known in the art, when a golf ball is hit by a driver, there is great impact force. The whole ball is deformed under this impact force. Consequently, the entire construction of the ball accounts for its initial launch conditions and ensuing flight performance. In the instant invention, the critical difference contributing to the superior distance capability is the center weight , the thread windings layer, and the total construction of the golf ball.

While the present invention has been described in connection with preferred embodiments thereof, it will be apparent to those skilled in the art that many changes and modifications may be made without departing from the true spirit and scope of the present invention. It is to be understood that the instant invention is by no means limited to the particular embodiments herein disclosed, but also comprises any modifications or equivalents within the scope of the claims.

Accordingly, it is intended by the appended claims to cover all such changes and modifications as come within the true spirit and scope of the invention. Having thus described our invention, what we claim as new and desire to secure by United States Letters Patent is:

1. A three-piece golf ball comprising:

a core comprising a rubber sphere and a thread windings layer;

a cover having a Shore D hardness in the range of about 46 Shore D to about 54 Shore D, wherein said cover is polyurethane having a curing agent comprising:

(1) a slow-reacting diamine;

(2) a fast-reacting diamine; and, an outer surface divided into a plurality of regular polygonal configurations including pentagons, squares and triangles; and, a plurality of dimples disposed in a uniform pattern within each of said plurality of regular polygonal configurations upon said cover wherein the ball has a compression in the range of about 70 PGA to about 100 PGA.

2. The ball of claim 1 further comprising:

a plurality of dimples arranged on the outer surface with a first pattern of dimples associated with each triangle, a second pattern of dimples associated with each pentagon and a third pattern of dimples associated with each square wherein the center has a liquid filling with a diameter in the range of about 1.00 inches to about 1.25 inches, wherein said center has a weight of about between 17 grams to 19 grams and wherein said thread windings layer has a Swartz modulus between 160 to 240 p.s.i., and said thread windings layer is wound at a tension in the range of about 700 grams tension to about 950 grams.

3. The ball of claim 1 wherein said slow-reacting diamine is dimethylthio-2,4-toluenediamine and said fast-reacting diamine is diethyl-2,4-toluenediamine.

4. The ball of claim 3 wherein said cover is a polyurethane that further comprises toluene diisocyanate and polytetramethylene ether glycol.

5. The ball of claim 1 wherein the thread windings layer has a thickness of about 0.20 inches to 0.26 inches.

6. The ball of claim 1 wherein the cover has a thickness of about 0.015 inches to 0.065 inches.

7. The golf ball of claim 1 a further comprising fifteen parting lines along great circle paths for further dividing said outer surface, said parting lines combining to essentially divide each pentagon into ten smaller triangles of equal size, each triangle into six triangles of equal size and each square into four smaller squares of equal size to obtain an outer surface consisting of smaller triangles and squares.

8. The golf ball of claim 1 further comprising:

a first set of dimples, with each dimple in the first set having a first size;

a second set of dimples, with each dimple in the second set having a second size; and, a third set of dimples, with each dimple in the third set having a third size, wherein the plurality of dimples are selected from the first set of dimples, the second set of dimples, and the third set of dimples.

9. The golf ball of claim 8 wherein said first set of dimples has a diameter in the range of about 0.154 inches to about 0.158 inches.

10. The golf ball of claim 8 wherein said second set of dimples has a diameter in the range of about 0.142 inches to about 0.147 inches.

11. The golf ball of claim 8 wherein said third set of dimples has a diameter in the range of about 0.140 inches to about 0.144 inches.

12. The golf ball of claim 8 wherein said first set of dimples has a radius of about 0.3843 inches.

13. The golf ball of claim 8 wherein said second set of dimples has a radius of about 0.3325 inches.

14. The golf ball of claim 8 wherein said third set of dimples has a radius of about 0.3191 inches.

15. A three-piece golf ball comprising:

a core comprising a center and a thread windings layer, wherein said center has a weight of about between 17 grams to 19 grams and wherein the center has a diameter in the range of about 1.00 inches to about 1.25 inches, and wherein said thread windings layer has an unstressed thread dimension of about 0.020 inches to 0.028 inches by 1/16 of an inch thick, and has a Swartz modulus between 160 to 240 p.s.i., wherein the threads in said thread windings layer are wound at a tension in the range of about 700 grams tension to about 950 grams and wherein the threads in said thread windings layer are wound in an open great circle pattern, wherein the thread windings layer has a thickness of about 0.20 inches to 0.26 inches;

a cover having a Shore D hardness in the range of about 46 Shore D to about 54 Shore D wherein the cover has a thickness of about 0.015 inches to 0.065 inches;

an outer surface divided into a plurality of polygonal configurations defined as a rhombicosadodecahedron, which include pentagons, squares and triangles; and, a plurality of dimples arranged on the outer surface with a first pattern of dimples arranged with each triangle, a second pattern of dimples associated with each pentagon and a third pattern of dimples associated with each square.

16. The golf ball of claim 15 wherein said dimples are dual radius in cross section.

17. The golf ball of claim 15 wherein the total number of dimples is at least 402.

18. The golf ball of claim 15 wherein said dimples have a range of depth from about 0.0074 inches to about 0.0082 inches.

19. The golf ball of claim 15 wherein the ball has a compression in the range of about 70 PGA to about 100 PGA.

20. The golf ball of claim 15 further comprising:

two poles;

an uninterrupted equatorial great circle path defining a mold parting line symmetrically positioned with respect to said two poles on said outer surface; and, a pair of first polygonal configurations each being located on opposite sides of said outer surface to include one of said two poles symmetrically arranged within its boundaries.

21. A three-piece golf ball comprising:

a core comprising a center and a thread windings layer, wherein said center has a weight of about between 17 grams to 19 grams, and wherein said thread windings layer has an unstressed thread dimension of about 0.020 inches to 0.028 inches by 1/16 of an inch, and has a Swartz modulus between 160 to 240 p.s.i.;

a cover having a Shore D hardness in the range of about 46 Shore D to about 54 Shore D, with said cover further comprising:

(a) a polyurethane prepolymer comprising:

(1) a diisocyanate; and, (2) a polyol; and, (b) a curing agent comprising:

(1) a slow-reacting diamine; and, (2) a fast-reacting diamine.

an outer surface divided into a plurality of polygonal configurations, which include pentagons, squares and triangles; and, a plurality of dimples arranged on the outer surface with a first pattern of dimples associated with each triangle, a second pattern of dimples associated with each pentagon, and a third pattern of dimples associated with each square.

22. The golf ball of claim 21 wherein the diisocyanate is selected from the group consisting of toluene diisocyanate, 4,4'-diphenylmethane diisocyanate, Isophorone diisocyanate and any mixtures thereof.

23. The ball of claim 22 wherein the polyol is an ether glycol.

24. The ball of claim 22 wherein the polyol is polytetramethylene glycol.

25. The golf ball of claim 22 wherein the curing agent comprises a slow-reacting diamine with diethyl-2,4-toluenediamine.

26. The golf ball of claim 22 wherein the curing agent comprises dimethylthio-2,4-toluenediamine and a fast-reacting diamine.

27. The golf ball of claim 21 wherein the curing agent comprises a blend of dimethylthio-2,4-toluenediamine and diethyl-2,4-toluenediamine.

28. The golf ball of claim 21 wherein said center has a liquid filled center comprising:

a) Polyethylene oxide;

b) Fumed silica;

c) Ammonia;

d) Ethylamine;

e) Ethylene oxide;

f) Calcium as mixed salts;

g) Butylated hydroxytoluene;

h) Sucrose; and, i) Stearic acid.

29. A thread-wound golf ball comprising:

a liquid-filled spherical rubber center;

a thread windings layer surrounding the rubber center;

a polyurethane cover having an outer surface and an inner surface, said inner surface in contact with and penetrating the thread windings layer and enclosing the thread windings layer therewith;

wherein the golf ball has a compression in the range of about 70 PGA to about 100 PGA; and wherein the center has a weight of from 17 grams to 19 grams, and a diameter in the range of about 1.00 inches to about 1.25 inches; and wherein the thread windings layer has threads wound in an open great circle pattern to a thickness of between 0.20 and 0.26 inches;

wherein the cover has a thickness of about 0.015 inches to 0.065 inches and a Shore D hardness in the range of about 46 Shore D to about 54 Shore D;

a first set of dimples, with each dimple in the first set having a first size;

a second set of dimples, with each dimple in the second set having a second size; and, a third set of dimples, with each dimple in the third set having a third size.

30. A method of preparing a golf ball comprising:

a) providing a liquid-filled rubber center;

b) freezing the rubber center;

c) wrapping the frozen rubber center with thread windings in an open great circle pattern with a thread tension from about 700 grams to 950 grams, to a thread winding thickness of between 0.20 inches and 0.26 inches, wherein the thread windings have an unstressed thread dimension of about 1/16th of an inch width by about 0.020 inches to 0.028 inches height, a Swartz modulus between 160 to 240 p.s.i.;

d) providing a polymer mixture;

e) pouring the polymer mixture into a first mold half and allowing the mixture to reach a semi-gelled state;

f) pouring the polymer mixture into a second mold half and allowing the mixture to reach a semi-gelled state;

g) lowering the rubber center with thread windings into the semi-gelled polymer mixture in the first mold half such that the rubber center with thread windings is suspended in the semi-gelled polymer mixture;

h) allowing the semi-gelled polymer mixture to penetrate the thread windings;

i) inverting the first mold half and mating it to the second mold half;

j) heating the mated first and second mold halves containing the polymer mixture and the rubber center with thread windings;

k) cooling the mated first and second mold halves containing the polymer mixture and the rubber center with thread windings; and l) removing the molded golf ball from the first and second mold halves and allowing the golf ball to cure.

31. A method of preparing a wound golf ball comprising:

a) providing rubber center;

b) wrapping the rubber center with thread windings having a Swartz modulus between 160 to 240 p.s.i., with a thread tension from about 700 grams to 950 grams;

c) providing a polymer mixture;

d) pouring said polymer mixture into a first mold half and allowing said mixture to reach a semi-gelled state;

e) pouring said polymer mixture into a second mold half and allowing said mixture to reach a semi-gelled state;

f) lowering said rubber center with thread windings into the semi-gelled polymer mixture in the first mold half such that the rubber center with thread windings is suspended in the semi-gelled polymer mixture;

g) allowing the semi-gelled polymer mixture to penetrate the thread windings;

h) inverting the first mold half and mating it to the second mold half;

i) cooling the mated first and second mold halves containing the polymer mixture and the rubber center with thread windings; and, j) removing the molded golf ball from the first and second mold halves and allowing the golf ball to cure.

32. The method of claim 31 further comprising the steps of:

preparing the polymer mixture by selecting a diisocyanate.

33. The method of claim 32 further comprising the steps of:

preparing the polymer mixture by selecting a diisocyanate selected from the group consisting of toluene diisocyanate, 4,4'-diphenylmethane diisocyanate, Isophorone diisocyanate and any mixtures thereof.

34. The method of claim 32 further comprising the steps of:

selecting a polyol for the polymer mixture;

mixing the diisocyanate with the polyol and a curative in a one shot process.

35. The method of claim 34 wherein the polyol selected is polytetramethylene ether glycol.

36. The method of claim 32 further comprising the steps of:

preparing a polymer mixture by selecting a diisocyanate selected from the group consisting of toluene diisocyanate, 4,4'-diphenylmethane diisocyanate, Isophorone diisocyanate and any mixtures thereof, providing a curative;

mixing the diisocyanate with polytetramethylene ether glycol.

37. The method of claim 32 wherein the curative comprises a sterically hindered slow reacting diamine with diethyl-2,4-toluenediamine.

38. The method of claim 32 wherein the curative comprises dimethylthio-2,4-toluenediamine and a fast-reacting diamine having no steric hindrance.

39. The method of claim 32 wherein the curative comprises a blend of dimethylthio-2,4-toluenediamine and diethyl-2,4-toluenediamine.

* * * * *